United States Patent [19]
Reynolds

[11] 4,194,540
[45] Mar. 25, 1980

[54] WATER JET LOOM

[75] Inventor: James R. Reynolds, Spartanburg, S.C.

[73] Assignee: Milliken Research Corporation, Spartanburg, S.C.

[21] Appl. No.: 952,284

[22] Filed: Oct. 18, 1978

[51] Int. Cl.² ..... D03D 49/00
[52] U.S. Cl. ..... 139/291 R; 139/435
[58] Field of Search ..... 139/11, 20, 435, 291 R, 139/291 C; 219/342

[56] References Cited

U.S. PATENT DOCUMENTS 3,961,650 6/1976 Marowsky ..... 139/291 R
3,961,651 6/1976 Balentine ..... 139/291 R

FOREIGN PATENT DOCUMENTS 1340959 12/1973 United Kingdom ..... 139/291 R

*Primary Examiner*—Henry Jaudon
*Attorney, Agent, or Firm*—Earle R. Marden; H. William Petry

[57] ABSTRACT

A water jet loom in which heat generated by the vacuum source blower is recycled to the fabric heater to reduce the amount of auxiliary heat needed to dry the fabric as it passes to the take-up roll.

10 Claims, 5 Drawing Figures

WATER JET LOOM

In recent years, the water jet loom has been employed more and more in the production of woven fabric. One of the drawbacks of the water jet loom is that on many styles of fabric it is necessary to dry the fabric after it is woven and before it is taken up in roll form. Prior to the invention, electric resistance heaters have been employed to primarily accomplish the drying of the fabric, but as is well known, this requires the use of a considerable amount of energy.

Therefore, it is an object of the invention to provide a water jet loom which utilizes heat generated in the operation of the loom to reduce the amount of electrical heat required to dry the fabric being woven by the loom.

Other objects and advantages of the invention will be clearly apparent as the specification proceeds to describe the invention with reference to the accompanying drawings, in which.

Figure 1:
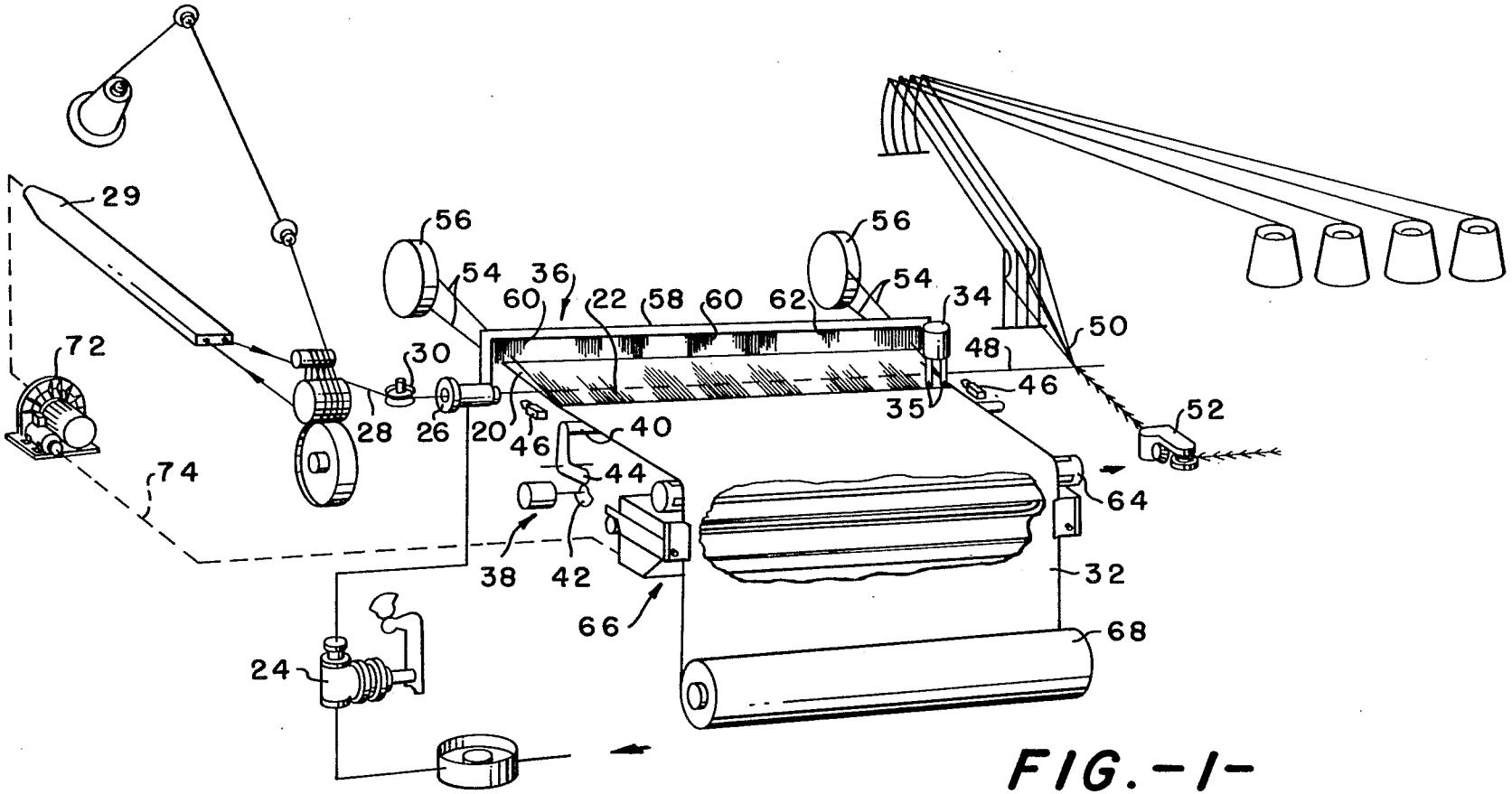
FIG. 1 is a schematic representation of the new and improved water jet loom.

Looking now to FIG. 1, shed 20 is formed by displacing certain selected yarns of the warp 22 vertically by means of heddles (not shown). Jet pump 24 forces pulses of water from jet nozzle 26 which withdraws weft yarn 28 evacuated by suction pump 72, from suction tube 29 and forces it into shed 20. When weft yarn 28 has fully traversed the width of fabric 32, gripper 30 grips weft yarn 28 and allows it to begin to accumulate in suction tube 29, and simultaneously reed 36 moves forward to beat weft yarn 28 into shed 20. If weft yarn 28 has fully traversed warp 22 it is sensed by yarn detector 34 which has a pair of electrical contacts 35 which contact the wet weft yarn 28. While mechanical yarn detectors are used in some water jet looms, electrical yarn detectors such as shown here are preferred since they allow the loom to achieve higher operating speeds. The electrical weft detector operates by sensing the slight conductivity of the water on the wet weft yarn as it contacts both contacts 35 of yarn detector 34. Should weft yarn 28 fail to achieve a complete traversal of the warp of the loom, no signal will be passed along the wet weft yarn between contacts 35 and an automatic shut-off mechanism (not shown) will stop the loom until an operator can remedy the problem.

Reed 36 comprises a frame 58 and a plurality of flattened stainless steel wires 60 forming dents 62 through which warp yarns 22 pass. The location at which weft yarn 28 contacts the flattened wires 60 of reed 36 may be varied by providing reed protection device 38 here shown comprising fabric support bar 40 connected to cam 42 by linkage 44. As cam 42 is rotated, linkage 44 moves fabric support bar 40 vertically varying the point of impact of reed 36 with weft yarn 28 as it is beat into position in shed 20. Reed 36 also forces weft yarn 28 against knives 46 which sever its weft yarn 28. Leading end 48 of weft yarn 28 passes between catch cords 50 which are twisted by catch cord spindle 52 causing catch cords 50 to trap and retain leading ends 48. Selvedges are formed on fabric 32 by the action of leno yarns 54 which issue from leno yarn dispensers 56 which rotate about their axis enabling leno yarns 54 to lock each weft yarn 28 into place.

After the fabric 32 has been formed it passes over sand roll 64 and the heater 66 to the take-up roll 68. The heater 66, shown in detail in FIGS. 2–5, dries the fabric 32 prior to take-up on the roll 68. Heater 66 is mounted under the sand roll 64 and is supplied heat from two sources, namely from the electric resistance heater 70 and from the heat generated by the vacuum pump motor 72 via conduit 74.

Figure 2:
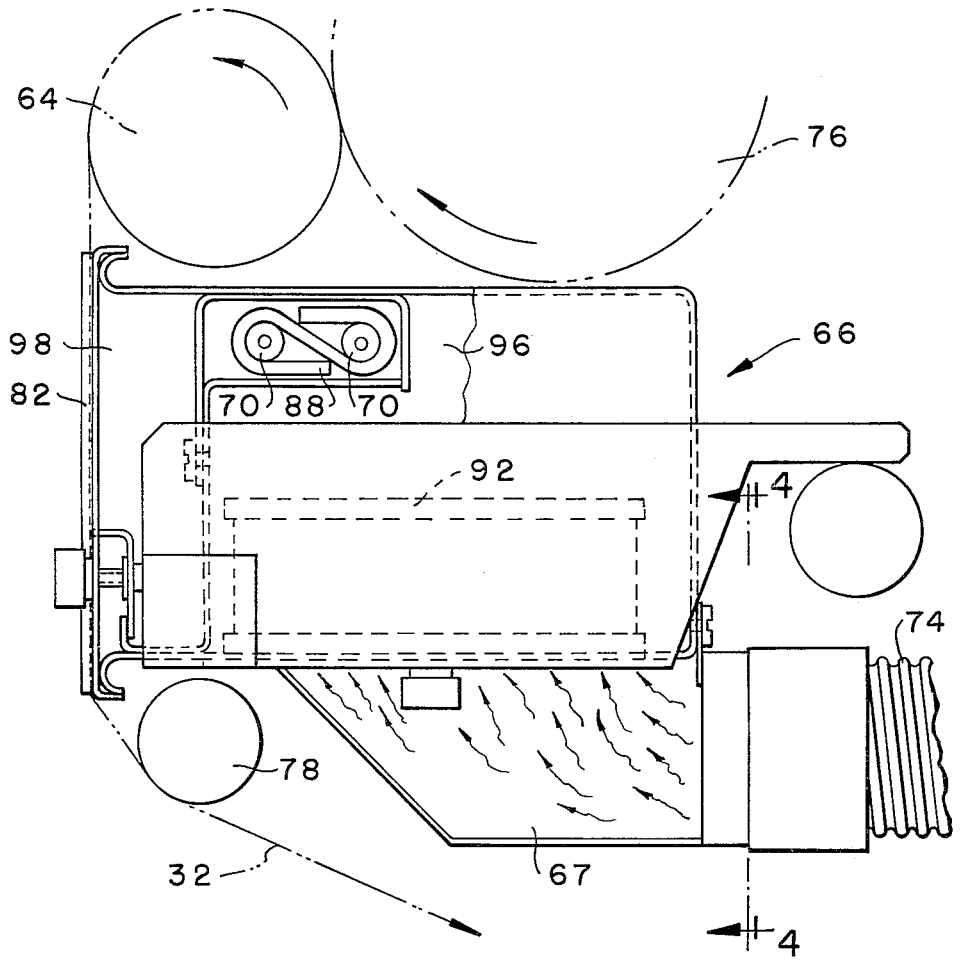
FIG. 2 is a cross-sectional view of the water jet loom heater.
Figure 3:
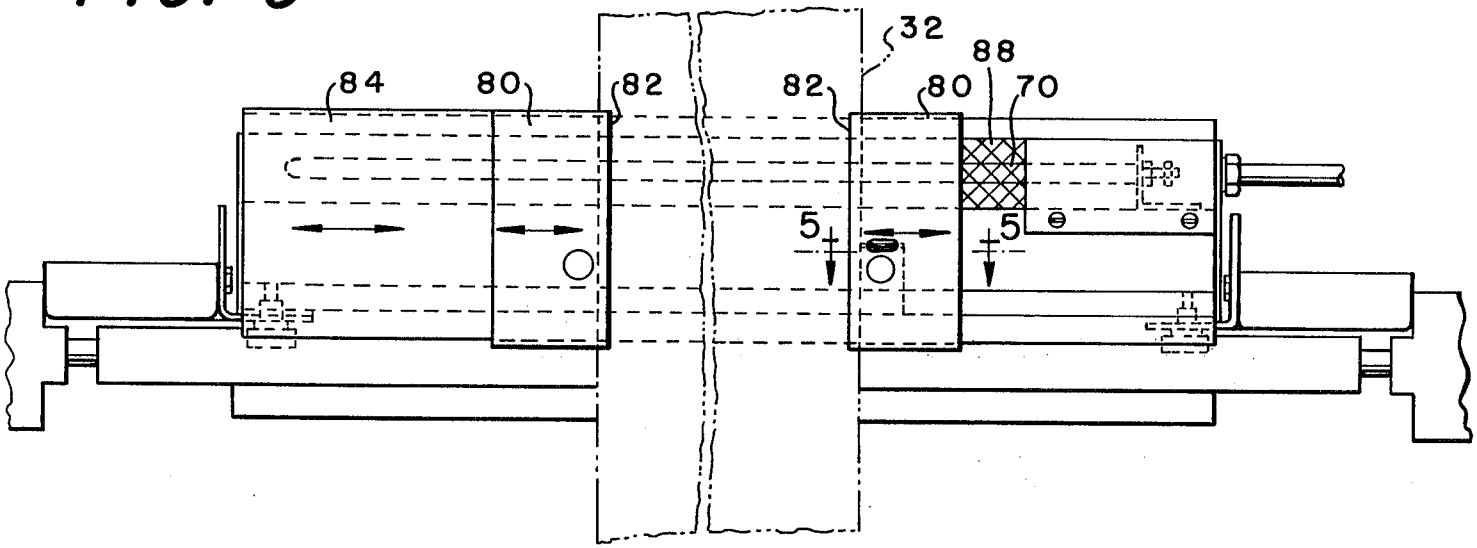
FIG. 3 is a front view of the water jet loom heater.
Figure 5:
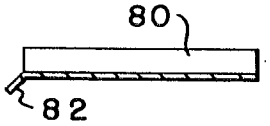
FIG. 5 is a view taken on line 5—5 of FIG. 3.

Looking now to FIG. 2, the fabric 32 is delivered to the sand roll 64 by roll 76 and passes vertically downward past the face of the heater 66 to the idler roll 78 which guides it to the take-up roll 68. Looking at FIG. 3, the fabric 32 is guided by adjustable plates 80 which can be moved inward or outward depending on the width of fabric so that the upturned lip 82 will telescope the edge of the fabric. Mounted on the ends of the face of the heater 66 are plates 84 to block off the end of the heater outlet. In FIG. 3, the right hand plate 84 has been removed to show the electric heater 70 and the distribution guide 88.

Figure 4:
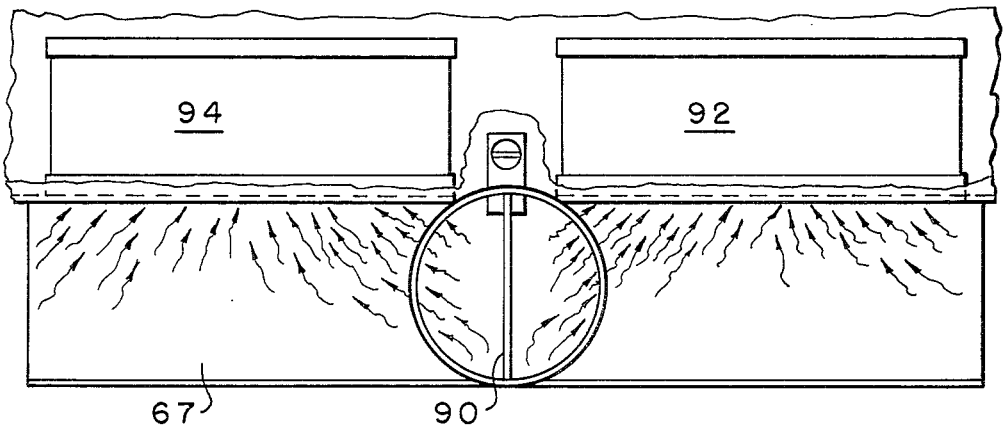
FIG. 4 is a view taken on line 4—4 of FIG. 2.

Looking now to FIGS. 2 and 4, the heater 66 is shown in detail. Mounted on the bottom of heater 66 is the air guiding plenum 67 which is supplied with heat from the vacuum blower 72 via conduit 74 and which is divided by baffle 90 to divide the warm air flow to the fans 92 and 94. The fans 92 and 94 deliver the air into the upper plenum area 96 and into the front plenum chamber 98 over the electric resistance heater 70. The pressure of the air from the fans 92 and 94 will blow the warm air from the chamber 98 through the fabric 32 to dry the fabric as it passes over the face of the heater 66. The amount of residual heat in the duct 74 from the vacuum source 72 greatly reduces the amount of additional energy required by the heater 66 resulting in reduced power requirements and expense.

It is obvious that a heater for a water jet loom has been provided which will reduce the amount of auxiliary heat required to efficiently dry the fabric woven by the loom. This has been accomplished by the utilization of heat generated by another operation of the loom and therefore is readily available for use.

Although the preferred embodiment of the invention has been described in detail, it is contemplated that many changes may be made without departing from the scope or spirit of the invention and I desire to be limited only by the claims.

I claim:

1. A water jet loom having: a frame; warp forming means mounted on said frame for forming a warp having a plurality of substantially parallel warp yarns; shed forming means mounted on said frame for displacing selected ones of said warp yarns to form a shed; weft inserting means mounted on said frame for inserting weft yarns into said shed, said weft inserting means including a jet nozzle, and jet pump means operably connected to said jet nozzle for forcing pulses of water through said jet nozzle and forcing weft yarns across said warp through said shed; said weft inserting means including a suction tube to store weft yarn and means to apply suction pressure to said suction tube, means to take-up fabric woven by said water jet loom, drying means mounted on said frame between said shed forming means and said means to take-up fabric to dry the fabric woven by said water jet loom and means to supply a separate source of heat to said drying means from a source operably associated with said water jet loom and separate from said drying means.

2. The water jet loom of claim 1 wherein said means to apply suction pressure to said suction tube includes a blower with the heat from said blower being supplied to said dryer means.

3. The water jet loom of claim 1 wherein said dryer means includes an electric resistance heater therein.

4. The water jet loom of claim 1 wherein dryer means includes an elongated casing, means forcing an opening in one side of said casing for the passage of fabric thereover, heating means mounted in said casing and means to pass the heat from the separate source over said heating means to said opening in said casing.

5. The water jet loom of claim 4 wherein said means to pass the heat from the separate source includes a fan means.

6. The water jet loom of claim 5 wherein adjustable plate means are mounted over said opening to vary the width of said opening depending on the width of fabric to be dried.

7. The water jet loom of claim 2 wherein dryer means includes an elongated casing, means forcing an opening in one side of said casing for the passage of fabric thereover, heating means mounted in said casing and means to pass the heat from the separate source over said heating means to said opening in said casing.

8. The water jet loom of claim 7 wherein said means to pass the heat from the separate source includes a fan means.

9. The water jet loom of claim 8 wherein adjustable plate means are mounted over said opening to vary the width of said opening depending on the width of fabric to be dried.

10. The method of producing a fabric on a water jet loom comprising the steps of: weaving a fabric by projecting pulses of water across the loom to carry the yarn across the loom, beating the weft yarn into the shed of the loom, drying the fabric after weaving the fabric by directing heat from an operational portion of the loom which generates heating during the performance of its function to the woven fabric, supplying a separate source of auxiliary heat to the heat already supplied for drying of the fabric and taking up the dried fabric in roll form.

* * * * *